United States Patent [19]

Grimmer et al.

[11] 4,321,043

[45] Mar. 23, 1982

[54] RECOIL FORCE AND WEIGHT LOSS SIMULATION DEVICE

[75] Inventors: Paul D. Grimmer, Winter Park; Edmund Swiatosz, Maitland, both of Fla.

[73] Assignee: The United States of America as represented by the Secretary of the Navy, Washington, D.C.

[21] Appl. No.: 208,757

[22] Filed: Nov. 20, 1980

[51] Int. Cl.[3] ..... F41F 27/00

[52] U.S. Cl. ..... 434/18

[58] Field of Search ..... 423/12, 18

[56] References Cited

U.S. PATENT DOCUMENTS

| | | | |
|---|---|---|---|
| 2,520,281 | 8/1950 | Heide | 434/18 |
| 4,050,166 | 9/1977 | Swiatosz et al. | 434/18 |
| 4,079,525 | 3/1978 | Linton et al. | 434/18 |
| 4,194,304 | 3/1980 | Wolcott | 434/18 |
| 4,290,757 | 9/1981 | Marshall et al. | 434/12 |

*Primary Examiner*—William H. Grieb

*Attorney, Agent, or Firm*—Robert F. Beers; Robert W. Adams; David S. Kalmbaugh

[57] ABSTRACT

A recoil force and weight loss simulator is disclosed which generates various predetermined forces that may be imparted to training weapons, and other devices so as to give them realistic operational characteristics which they otherwise would not have. The recoil force and weight loss simulator includes first force generating means adapted to move a weapons support stand and, thus, an imitation weapon effectively mounted on the weapons support stand in a rearward direction when activated, and second force generating means adapted to release a weight, when activated, from a predetermined position above a terrain surface such that the weight will fall freely to the terrain surface. Actuating means activates the first and second force generating means whenever a marksman triggers the trigger mechanism of the imitation weapon such that the marksman will experience a recoil force and weight loss upon firing the weapon.

12 Claims, 5 Drawing Figures

RECOIL FORCE AND WEIGHT LOSS SIMULATION DEVICE

BACKGROUND OF THE INVENTION

1. Field of the Invention

This invention relates generally to weapons training simulators. In particular, this invention relates to a device for simulating the recoil force and weight loss a marksman would experience upon firing a weapon which launches therefrom a rocket propelled projectile or the like.

2. Description of the Prior Art

In the prior art, the training of military personnel in the use of weapons systems, such as the bazooka, the Dragon missile launcher, the TOW weapons system, or the like has usually been accomplished by having them use live ammunition in the weapons in which they are to be trained. This, in turn, requires the expenditure of large amounts of expensive ammunition while subjecting the untrained personnel to a certain amount of danger in handling equipment which they are unaccustomed to operating.

A variety of weapons simulators have been designed to simulate the firing of weapons systems which launch therefrom, when triggered, rocket propelled projectiles, or the like. One such device of the prior art which may be utilized to train military personnel in the use of weapons systems, such as the bazooka, is the Burst On Target Simulator Device For Training With Rockets described in U.S. patent application, Ser. No. 157,750, now U.S. Pat. No. 4,290,757, issued Sept. 22, 1981, by Albert H. Marshall, and Herbert C. Towle. While satisfactory for its intended purpose of training military personnel in the use of rocket launching weapons systems, the aforementioned device leaves something to be desired in that it fails to simulate the recoil force or weight loss a marksman would experience when firing the aforementioned weapons simulator. This, in turn, would affect the aiming accuracy of a marksman utilizing the weapons system described in the above mentioned U.S. patent application Ser. No. 157,750.

SUMMARY OF THE INVENTION

The subject invention overcomes some of the disadvantages of the prior art, including those mentioned above, in that it comprises a relatively simple recoil force and weight loss simulation device, which may be utilized with a rocket launching weapons system to simulate the recoil force and weight loss a marksman would experience upon firing the aforementioned weapons system.

Included in the subject invention is an imitation weapon having a trigger mechanism, an adjustable height weapons support stand having a pair of legs, and a weapons brace assembly rotatably mounted on the weapons support stand and having a yoke connected to the imitation weapon. The legs of the weapons support stand are adapted to fit within a support plate which is slidably mounted on a base plate. A first pneumatic actuator which, when activated by actuating means, moves the support plate in a rearward direction such that a marksman, upon firing the imitation weapon, will experience a recoil force against his shoulder. Simultaneously, therewith a second pneumatic actuator, activated by the aforementioned actuating means, will release from a predetermined position above a terrain surface a weight support bar rotatably connected to the weapons support stand, and a weight affixed to the weight support bar.

The weight then falls to the ground and comes to rest thereon so as to simulate the weight loss a marksman will experience when firing the aforementioned imitation weapon.

DESCRIPTION OF THE PREFERRED EMBODIMENT

Figure 1:
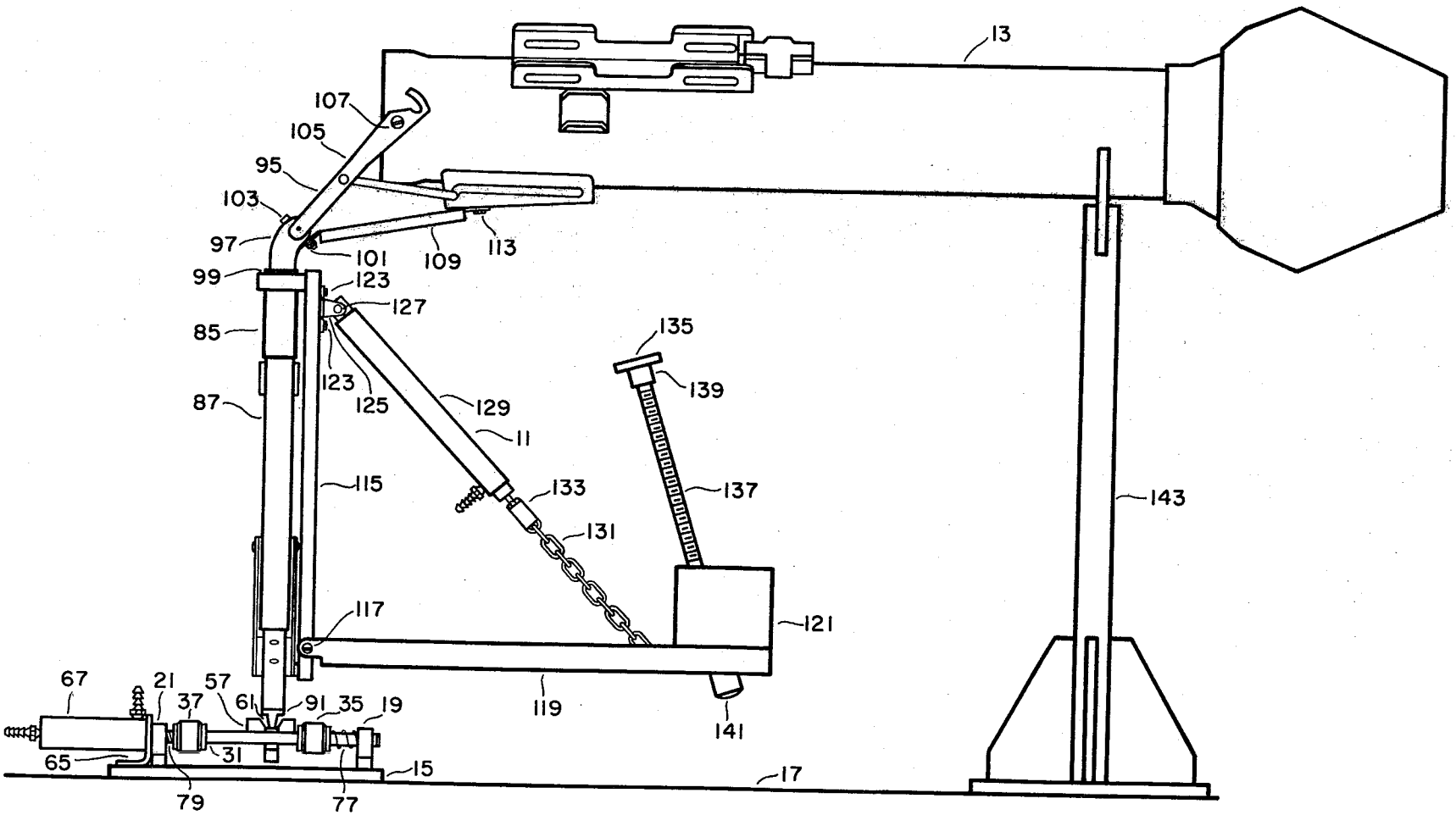
FIG. 1 is a side view of a weapons training simulator incorporating the recoil force and weight loss simulation device of the subject invention.

The preferred embodiment of the subject invention will now be discussed in some detail in conjunction with all of the figures of the drawing wherein like parts are designated by like reference numerals insofar as it is possible and practical to do so.

Figure 5:
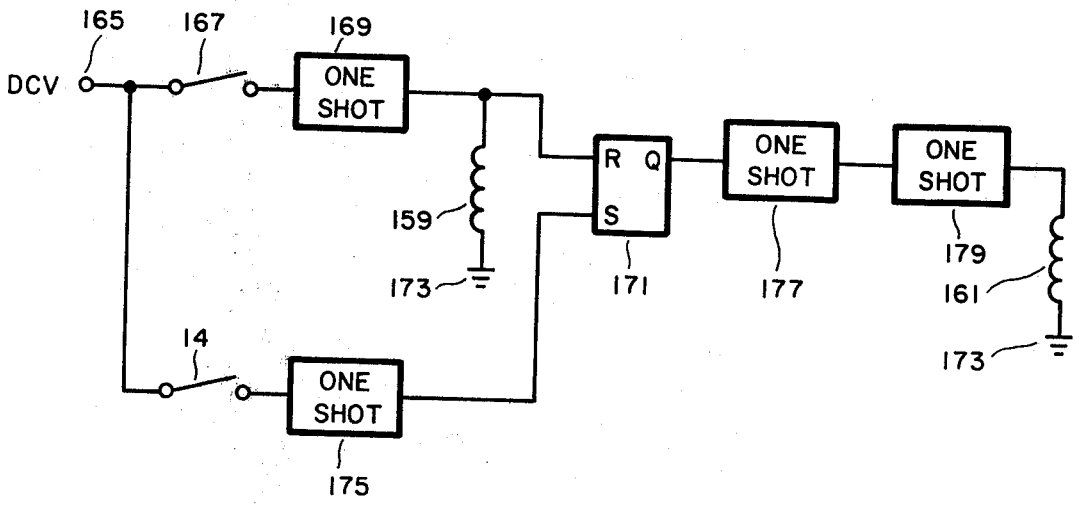
FIG. 5 is an electrical diagram of the circuit utilized to control the operation of the recoil force and weight loss simulation device of FIG. 1.

Referring first to FIG. 1, there is shown a recoil force and weight loss simulation device 11 which has mounted thereon an imitation weapon 13, having a trigger mechanism 14, FIG. 5. Recoil force and weight loss simulation device 11 is designed to simulate the weight loss and recoil force which a marksman, not shown, would experience upon firing weapon 13 which may be, for example, a Dragon missile launcher.

Figure 2:
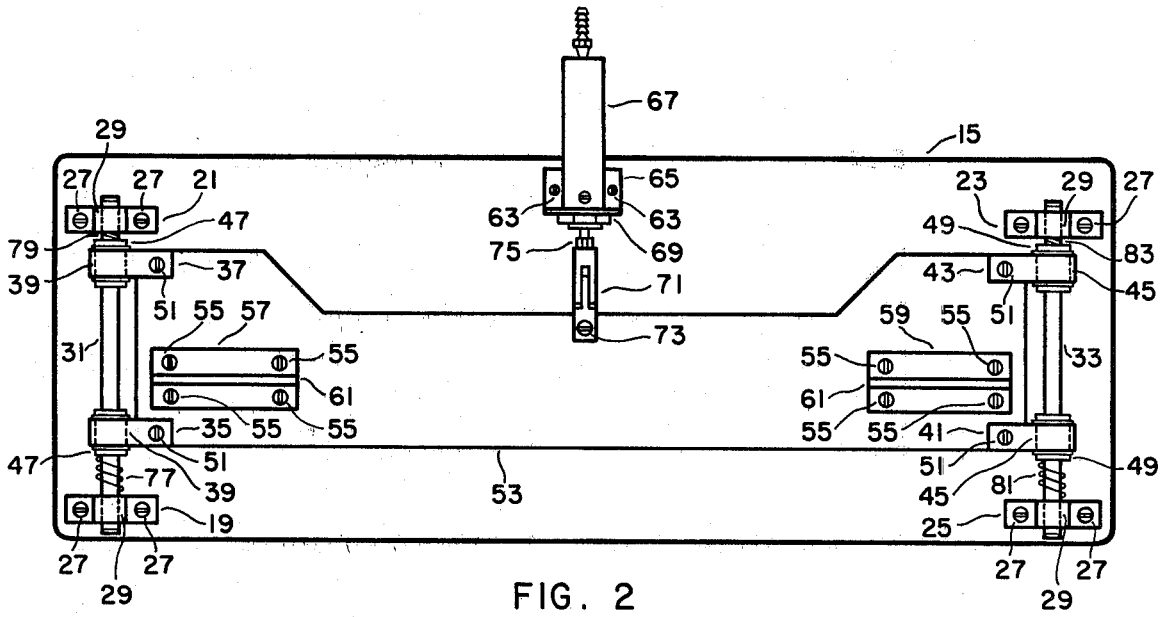
FIG. 2 is a detailed view of the recoil mechanism utilized by the subject invention of FIG. 1.

Referring now to FIGS. 1 and 2, there is shown simulator 11 which includes a rectangular shaped base plate 15. Base plate 15 is, in turn, mounted upon a terrain surface 17 which may be, for example, a target range. Located at the corners of rectangular shaped base plate 15 are a quartet of guide rod support brackets 19, 21, 23 and 25, each of which is affixed to base plate 15 by a pair of machine screws 27, and each of which has extending therethrough an aperture 29. At this time, it should be noted that aperture 29 of support bracket 19 is in alignment with aperture 29 of support bracket 21. Likewise, aperture 29 of support bracket 23 is in alignment with aperture 29 of support bracket 25.

Passing through aperture 29 of support bracket 19 and aperture 29 of support bracket 21 is a guide rod 31, which is secured to each of the aforementioned support brackets 19 and 21 by a set screw, not shown. Similarly, passing through aperture 29 of support bracket 23, and aperture 29 of support bracket 25 is a guide rod 33 which is parallel to guide rod 31 and which is secured to each of the aforementioned support bracket 23 and 25 by a set screw, not shown.

Slidably mounted upon guide rod 31 are a pair of plate support brackets 35 and 37, each of which has an aperture 39 which allows guide rod 31 to pass therethrough. Likewise, there is slidably mounted upon guide rod 33 a pair of plate support brackets 41 and 43, each of which has an aperture 45 which allows guide rod 33 to pass therethrough. Located between guide rod 31 and each aperture of support brackets 35 and 37 is a bearing assembly 47 which allows support brackets 35 and 37 to slide freely upon guide rod 31. Similarly, there is located between guide rod 33 and each aperture of support brackets 41 and 43 a bearing assembly 49 which allows support brackets 41 and 43 to slide freely upon guide rod 33.

Fixedly attached to support brackets 35, 37, 41, and 43, as by a plurality of machine screws 51 is a support plate 53. Mounted upon the upper surface of support plate 53 as by a plurality of machine screws 55 are a pair of rectangular shaped support blocks 57 and 59 each having located therein a channel 61. Channel 61 of support block 57 is in alignment with channel 61 of support block 59.

Mounted near the front of support plate 53 in the center thereof as by a pair of machine screws 63 is a pneumatic actuator support bracket 65 which has therein an aperture, not shown. Passing through the aperture of support bracket 65 is the threaded stem of a pneumatic actuator 67. A lock washer and nut 69 are screw threaded onto the threaded stem of pneumatic actuator 67 so as to affix pneumatic actuator 67 to support bracket 65.

The drive rod of pneumatic actuator 67 is connected to support plate 53 by clevis assembly 71 such that activation of pneumatic actuator 67 will move support plate 53 either in a forward direction or a rearward direction as will be discussed more fully below.

Clevis assembly 71 is, in turn, connected to support plate 53 by a machine screw 73, and to the drive rod of pneumatic actuator 67 by a locking nut 75.

Positioned between support bracket 19 and support bracket 35 around guide rod 31 is a spiral spring 77. Similarly, there is positioned between support bracket 21 and support bracket 37 around guide rod 31 a spiral spring 79. In addition, there is positioned between support bracket 25 and support bracket 41 around guide rod 33 a spiral spring 81. Likewise, there is positioned between support bracket 23 and support bracket 43 around guide rod 33 a spiral spring 83. Each of the aforementioned springs 77, 79, 81, and 83, in turn, maintain support plate 53 in a fixed position when pneumatic actuator 67 is not activated.

Figure 3:
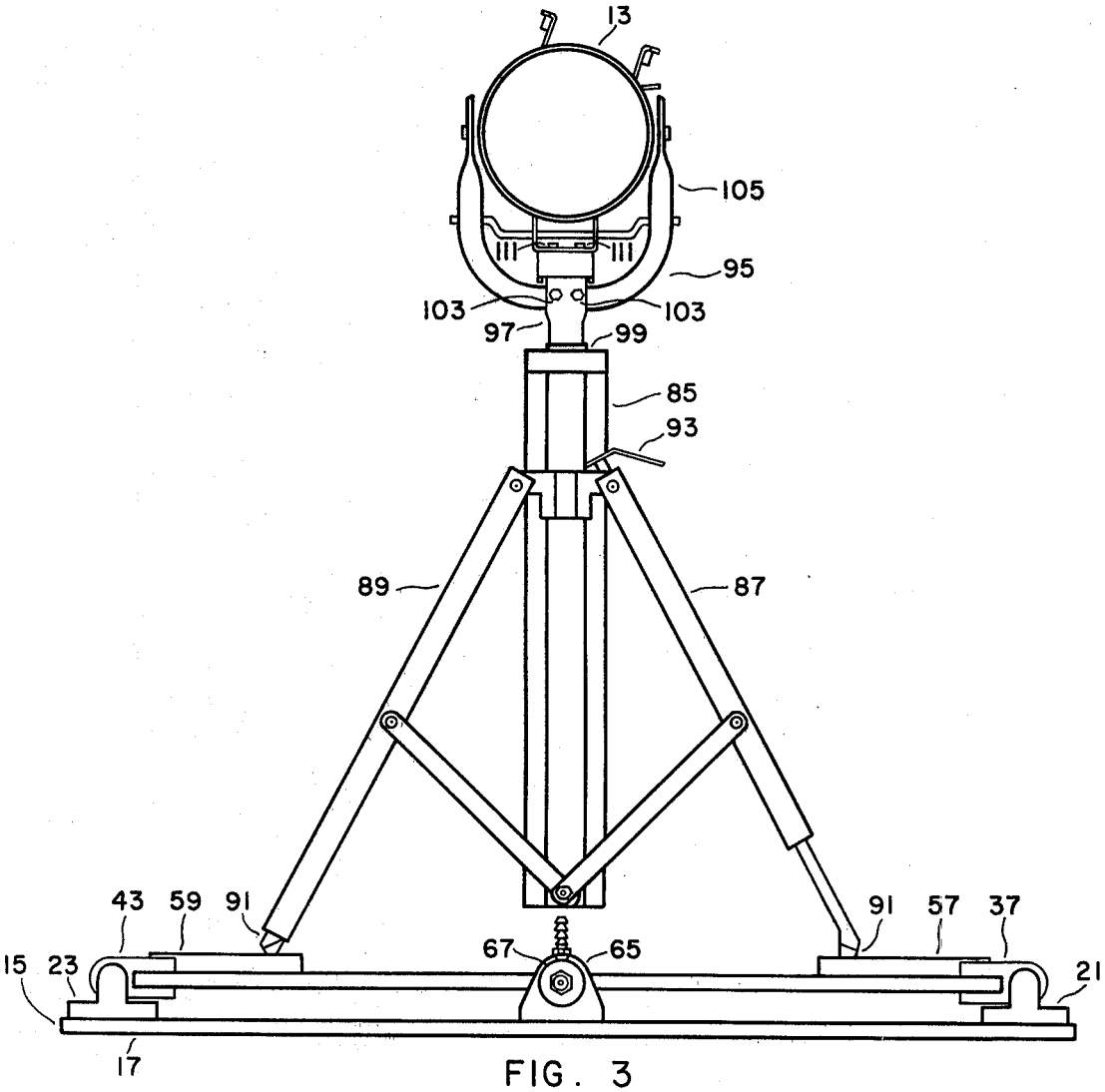
FIG. 3 is a frontal view of the recoil force and weight loss simulation device of FIG. 1.

Referring now to FIGS. 1, 2, and 3, there is shown an adjustable height weapons support stand 85 mounted upon base plate 15. Weapons support stand 85 includes a pair of legs 87 and 89, each of which has on the end thereof a tip 91. Tip 91 of leg 87 is adapted to fit within channel 61 of support block 57, and tip 91 of leg 89 is adapted to fit within channel 61 of support block 59 so as to allow for the translational movement of the aforementioned tips within channel 61 of support blocks 57 and 59.

At this time, it may be noteworthy to mention that weapons support stand 85 may be adjusted in a vertical direction by releasing a height adjustment lever 93 located thereon. This, in turn, allows the height of weapon 13 to be varied in accordance with the height of the marksmen, not shown, utilizing the subject invention.

A weapons brace assembly 95 is utilized to rotatably connect weapon 13 to weapons support stand 85 so as to allow for the rotational movement of weapon 13 about weapons support stand 85. Weapons brace assembly 95 includes a tubular shaped member 97 having on the periphery thereof a flange 99. Tubular shaped member 97, in turn, rotates within an aperture, not shown, located at the top of weapons support stand 85. Fixedly attached to tubular spaced member 97 as by a pair of nuts 101 and bolts 103 is a yoke 105 which is affixed to the periphery of weapon 13 by a pair of machine screws 107. In addition, nuts 101 and bolts 103 secure one end of a cross brace 109 to tubular shaped member 97 with the other end thereof being secured to the periphery weapon 13 by a pair of nuts 111 and bolts 113.

Fixedly attached to weapons support stand 85, as by a plurality of machine screws, not shown, is a weight loss simulator support bar 115. Rotatably connected to the lower end of weight loss simulator support bar 115, as by a pivot 117, is one end of a weight support bar 119. The opposite end of weight support bar 119, in turn, has affixed thereto, as by a plurality of machine screws, not shown, a weight 121.

Positioned at the upper end of weight loss simulator support bar 85, and secured thereto by a plurality of machine screws 123 is a pneumatic actuator support bracket 125. Rotatably connected to support bracket 125, as by a pivot 127, is a pneumatic actuator 129, the drive rod of which is connected to one end of a chain 131 by a clevis 133. The opposite end of chain 131 is, in turn, connected to weight support bar 119 by a chain support bracket, not shown.

Threadably connected through an internally threaded aperture, not shown, within weight 121 is an adjustable weight support assembly 135. Adjustable weight support assembly 135, in turn, includes an externally threaded rod 137 adapted to mate with the aforementioned internally threaded aperture of weight 121, an adjustment knob 139 affixed to the upper end of rod 137, and a bumper 141 affixed to the lower end of rod 137.

A this time, it should be noted that, as illustrated in FIG. 1, pneumatic actuator 129 is depicted in an activated state. This, in turn, causes pneumatic actuator 129, to hold weight 121 in a fixed position above terrain surface 17. Inactivation of pneumatic actuator 129 allows weight 121 to fall toward terrain surface 17 with pumper 141 of adjustable weight support assembly 135 breaking the fall of the aforementioned weight 121 as will be discussed more fully below.

Further, it should be noted that weight support assembly 135 is made adjustable so as to compensate for any adjustment in the height of weapons support stand 85 such that the distance weight 121 falls to terrain surface 17 will remain constant.

In addition, there is shown in FIG. 1 a support stand 143 which may be utilized to support weapon 13 when weapon 13 is not being used to train the aforementioned marksman, not shown.

Figure 4:
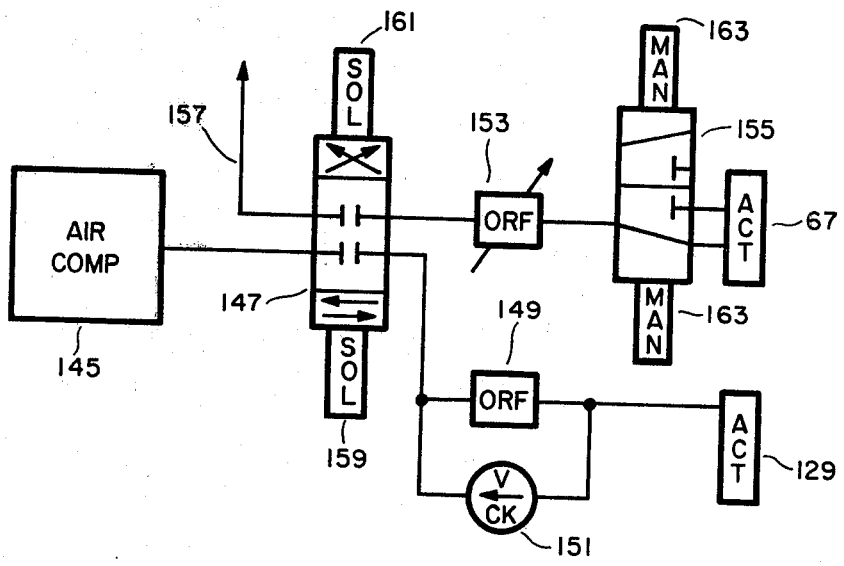
FIG. 4 is a pneumatic diagram of the recoil force and weight loss simulation device of FIG. 1.

Referring now to FIG. 4, there is shown an air compressor 145 having an outlet connected to the first port of a solenoid activated four-way valve 147, the second port of which is connected to the first port of an orifice 149, and the first port of a check valve 151. The second port of orifice 149 is, in turn, connected to the port of pneumatic actuator 129, and the second port of check valve 151.

The third port of four-way valve 147 is connected to the first port of an adjustable orifice 153, the second port of which is connected to the first port of a manually activated three way valve 155 with the second port thereof connected to the first port of pneumatic actuator 67. The second port of pneumatic actuator 67 is, in turn, connected to the third port of three way valve 155. In addition, the fourth port of four way valve 147 is connected to a discharge line 157.

At this time, it may be noteworthy to mention that four way valve 147 has mechanically connected thereto a pair of solenoids 159 and 161, which effect the activation of four way valve 147 in a manner to be described more fully below. In addition, it should be noted that three way valve 155 has thereon a manual control actuator switch 163 which effects the operation thereof in a manner to be described more fully below.

Referring now to FIG. 5, there is shown a positive direct current voltage source 165, the output of which is connected to the input of trigger mechanism 14, and to the input of a normally open switch 167. The output of switch 167 is connected to the input of a one-shot multivibrator 169, the output of which is connected to the reset input of an RS flip-flop 171 and the input of solenoid 159, with the output thereof connected to a ground 173. The output of trigger mechanism 14 is connected to the input of a one-shot multivibrator 175, the output of which is connected to the set input of RS flip-flop 171, with the output thereof connected to the input of a one-shot multivibrator 177. The output of one-shot multivibrator 177 is, in turn, connected to the input of a one-shot multivibrator 179, the output of which is connected to the input of solenoid 161, with the output thereof connected to ground 173.

The operation of the subject invention will now be discussed in conjunction with all of the figures of the drawing.

Referring now to FIGS. 1, 2, 4 and 5, whenever an instructor, not shown, closes normally open switch 167, the direct current voltage signal provided by direct current voltage source 165 will pass through switch 167 to the input of one-shot multivibrator 169. One-shot multivibrator 169, in response to the aforementioned direct current voltage signal, provides at the output thereof a pulse having a time period of approximately two seconds. The pulse provided by one-shot multivibrator 169 will then activate solenoid 159 so as to allow compressed air provided by air compressor 145 to pass through four way valve 147 and orifice 149 to pneumatic actuator 129. The compressed air provided by air compressor 145 activates pneumatic actuator 129 so as to cause the drive rod thereof to move in an upward direction. This, in turn, lifts weight 121 above terrain surface 17 to the position illustrated in FIG. 1. In addition, activation of solenoid 159 allows compressed air which was stored within pneumatic actuator 67 from a previous firing of weapon 13 to exit therefrom through orifice 153 four way valve 147, and discharge line 157 into the atmosphere. This, in turn, releases the drive rod of pneumatic actuator 67 so as to allow support plate 53 to return to a centrally located position above base plate 15.

At this time, it may be noteworthy to mention that weight 121 provides the same effective support load on a marksman's shoulder as would a jet propelled rocket, which would be fired from a weapon, such as a Dragon missile launcher, which the subject invention is designed to simulate. Thus, a marksman, not shown, will experience when firing imitation weapon 13 a weight loss similar to that which the marksman would experience upon firing a realistic weapon, as will be discussed more fully below.

It should also be noted at this time that the two second pulse provided by one-shot multivibrator 169 resets RS flip-flop 171 such that the Q output thereof will be in the logic "0" state.

When the aforementioned marksman, not shown, activates trigger mechanism 14 of weapon 13 by firing weapon 13, the direct current voltage signal provided by direct current voltage source 165 will pass through trigger mechanism 14 to the input of one-shot multivibrator 175. One-shot multivibrator 175, in response to the direct current voltage signal provided by direct current voltage source 165, will provide at the output thereof a pulse having a time duration of approximately one hundred microseconds. This pulse, in turn, sets RS flip-flop 171 such that the Q output thereof will change from a logic "0" state to a logic "1" state. The transition of the Q output of RS flip-flop 171 from a logic "0" state to a logic "1" state triggers one-shot multivibrator 177 such that one shot multivibrator 177 will produce at the output thereof a pulse having a time period of approximately seven hundred milliseconds.

The logic "1" to logic "0" transition of the pulse produced by one-shot multivibrator 177 triggers one-shot multivibrator 179 such that one-shot multivibrator 179 will produce at the output thereof a pulse having a time duration of approximately one second. The pulse produced by one-shot multivibrator 179 activates solenoid 161 so as to allow compressed air from air compressor 145 to pass through four way valve 147, adjustable orifice 153, and three way valve 155 to pneumatic actuator 67. This, in turn, activates pneumatic actuator 67 such that the drive rod thereof will move support plate 53, and thus weapons support stand 85 in a rearward direction upon guide rods 31 and 33, thereby exerting a recoil force upon the shoulder of the marksman, not shown, utilizing weapon 13.

Simultaneously therewith compressed air stored within pneumatic actuator 129, from the activation of solenoid 159 as discussed above, is discharged from pneumatic actuator 129 through check valve 151, four way valve 147, and discharge line 157 into the atmosphere. This, in turn, releases the drive rod of pneumatic actuator 129 so as to allow weight 121 to fall freely from its position above terrain surface 17 toward terrain surface 17, and come to rest thereon, thereby simulating the weight loss that the marksman, not shown, would experience from firing weapon 13. The aforementioned weight loss is, in turn, identical to the weight loss a marksman would experience when a jet propelled rocket exits from a realistic weapons system that the subject invention is designed to simulate.

At this time, it should be noted that three-way valve 155 may be adjusted by utilizing manual control actuator switch 163 such that activation of solenoid 161 will cause the drive rod of pneumatic actuator 67 to move support plate 53, and thus weapon 13 in a forward direction. This, in turn, allows for the simulation of a force which would move weapon 13 forward.

From the foregoing, it may readily be seen that the subject invention comprises a new, unique, and exceedingly useful recoil force and weight loss simulation device which constitutes a considerable improvement over the known prior art. Obviously, many modifications and variations of the present invention are possible in light of the above teachings. It is, therefore, to be understood that within the scope of the appended claims, the invention may be practiced otherwise than as specifically described.

What is claimed is:

1. A recoil and weight loss simulation device comprising in combination:

a weight located at a predetermined position above a terrain surface, said weight having an internally threaded aperture extending therethrough;

an imitation weapon having a trigger mechanism, said trigger mechanism having an input and output;

an adjustable height weapons support stand having a pair of legs, each leg of which has on the end thereof a tip;

a weapons brace assembly rotatably mounted on said adjustable height weapons support stand, said weapons brace assembly having a yoke affixed to the periphery of said imitation weapon;

first force generating means mounted upon said terrain surface and having a pair of ports, and a pair of channels, the first channel of which is adapted to receive the tip of the first leg of said adjustable height weapons support stand, and the second channel of which is adapted to receive the tip of the second leg of said adjustable height weapons support stand, for simulating the recoil force that a marksman experiences upon activating the trigger mechanism of said weapon by moving said weapon in a rearward direction against the shoulder of said marksman;

second force generating means fixedly attached to said adjustable height weapons support stand, having said weight effectively connected thereto, and having a port adapted for simulating the weight loss that a marksman experiences upon firing said imitation weapon by allowing said weight to fall freely from said predetermined position above said terrain surface to said terrain surface whenever said marksman activates the trigger mechanism of said imitation weapon; and actuating means having first, second, and third ports with the first port thereof connected to the first port of said first force generating means, with the second port thereof connected to the second port of said first force generating means, and with the third port thereof connected to the port of said second force generating means for simultaneously effecting the activation of said first force generating means, and said second force generating means whenever said marksman triggers the trigger mechanism of said imitation such that said marksman will experience the recoil force and weight loss generating by the firing of said imitation weapon.

2. The recoil and weight loss simulation device of claim 1 wherein said imitation weapon comprises a Dragon missile launcher.

3. The recoil and weight loss simulation device of claim 1 wherein said first force generating means comprises:

a base plate mounted upon said terrain surface;

first, second, third, and fourth guide rod support brackets affixed to said base plate;

a pair of parallel guide rods, the first guide rod of which is rigidly mounted between said first and said second guide rod support brackets, and the second guide rod of which is rigidly mounted between said third and said fourth guide support brackets;

first, second, third, and fourth plate support brackets, the first and second plate support brackets of which are slidably mounted upon said first guide rod, and the third and fourth plate support brackets of which are slidably mounted upon said second guide rod;

a support plate fixedly attached to said first, second, third, and fourth plate support brackets;

a pneumatic actuator support bracket mounted upon said base plate at the center thereof;

a pneumatic actuator affixed to said pneumatic actuator support bracket, said pneumatic actuator having a drive rod connected to said support plate, a first port connected to the first port of said actuating means, and a second port connected to the second port of said actuating means;

four spiral springs, the first of which is positioned between said first guide rod support bracket and said first plate support bracket around said first guide rod, the second of which is positioned between said second guide rod support bracket and said second plate support bracket around said first guide rod, the third of which is positioned between said third guide rod support bracket and said third plate support bracket around said second guide rod, and the fourth of which is positioned between said fourth guide rod support bracket and said fourth plate support bracket around said second guide rod;

a first rectangular shaped support block mounted upon said support plate, said first support block having therein a channel adapted to receive the tip of the first leg of said adjustable height weapons support stand; and a second rectangular shaped support block mounted upon said support plate and having therein a channel in alignment with the channel of said first rectangular shaped support block, the channel of said second rectangular shaped support block adapted to receive the tip of the second leg of said adjustable height weapons support stand.

4. The recoil and weight loss simulation device of claim 1 wherein said second force generating means comprises:

a weight loss simulator support bar fixedly attached to said adjustable height weapons support stand;

a weight support bar rotatably connected at one end thereof to the lower end of said weight loss simulator support bar, said weight support bar having said weight affixed thereto at the opposite end thereof;

a pneumatic actuator support bracket affixed to the upper end of said weight loss simulator support bar;

a pneumatic actuator rotatably connected to said pneumatic actuator support bracket, said pneumatic actuator having a port connected to the third port of said actuating means, and a drive rod; and a chain connected at one end thereof to the drive rod of said pneumatic actuator, and at the opposite end thereof to said weight support bar adjacent said weight.

5. The recoil and weight loss simulation device of claim 1 wherein said actuating means comprises:

a direct current voltage source having an output connected to the input of said trigger mechanism;

a first one-shot multivibrator having an input connected to the output of said trigger mechanism and an output;

a normally open switch having an input connected to the output of said direct current voltage source and an output;

a second one-shot multivibrator having an input connected to the output of said normally open switch, and an output;

a ground;

an RS flip-flop having a set input connected to the output of said first one-shot multivibrator, a reset input connected to the output of said second one-shot multivibrator, and a Q output;

a third one-shot multivibrator having an input connected to the Q output of said RS flip-flop, and an output;

a fourth one-shot multivibrator having an input connected to the output of said third one-shot multivibrator and an output;

a four-way valve having first, second, third, and fourth ports, and first and second solenoids, said first solenoid having an input connected to the output of said second one-shot multivibrator and an output connected to ground, and said second solenoid having an input connected to the output of said fourth one-shot multivibrator and output connected to ground;

an air compressor having an outlet connected to the first port of said four-way valve;

a first orifice having first and second ports with the first port thereof connected to the second port of said four-way valve, and with the second port thereof connected to the port of said second force generating means;

a check valve having first and second ports, with the first port thereof connected to the port of second force generating means, and the second port of said orifice, and with the second port thereof connected to the first port of said first orifice, and the second port of said four-way valve;

a second orifice having first and second ports with the first port thereof connected to the third port of said four way valve;

a three-way valve having a manual control actuator, and first, second, and third ports, with the first port thereof connected to the second port of said second orifice, with the second port thereof connected to the first port of said first force generating means, and with the third port thereof connected to the second port of said first force generating means; and a discharge line connected at one end thereof to the fourth port of said four way valve.

6. The recoil and weight loss simulation device of claim 1 further characterized by a support stand adapted to support said imitation weapon whenever said imitation weapon is not being utilized to train a marksman.

7. The recoil and weight loss simulation device of claim 1 further characterized by an adjustable weight support assembly having an externally threaded rod adapted to mate with the internally threaded aperture of said weight, an adjustment knob affixed to the upper end of said externally threaded rod, and a bumper affixed to the lower end of said externally threaded rod.

8. A recoil force and weight loss simulation apparatus comprising, in combination:

an imitation weapon having a trigger mechanism, said trigger mechanism having an input, and an output;

a direct current voltage source having an output connected to the input of said trigger mechanism;

a first one-shot multivibrator having an input connected to the output of said trigger mechanism and an output;

a normally open switch having an input connected to the output of said direct current voltage source and an output;

a second one-shot multivibrator having an input connected to the output of said normally open switch and an output;

a ground;

an RS flip-flop having a set input connected to the output of said first one-shot multivibrator, a reset input connected to the output of said second one-shot multivibrator, and a Q output;

a third one-shot multivibrator having an input connected to the Q output of said RS flip-flop, and an output;

a fourth one-shot multivibrator having an input connected to the output of said third one-shot multivibrator and an output;

a four-way valve having first, second, third and fourth ports and first and second solenoids, said first solenoid having an input connected to the output of said second one-shot multivibrator and an output connected to ground, and said second solenoid having an input connected to the output of said fourth one-shot multivibrator, and an output connected to ground.

an air compressor having an outlet connected to the first port of said four-way valve;

a first orifice having first and second ports, with the first port thereof connected to the second port of said four-way valve;

a check valve having first and second ports, with the first port thereof connected to the second port of said first orifice, and with the second port thereof connected to the first port of said first orifice, and the second port of said four-way valve;

a second orifice having first and second ports with the first port thereof connected to the third port of said four-way valve;

a three way valve having a manual control actuator switch and first, second, and third ports, with the first port thereof connected to the second port of said second orifice;

a base plate;

first, second, third, and fourth guide rod support brackets affixed to said base plate;

a pair of parallel guide rods, the first guide rod of which is rigidly mounted between said first and said second guide rod support brackets, and the second guide rod of which is rigidly mounted between said third and fourth guide rod support brackets;

first, second, third, and fourth plate support brackets, the first and second plate support brackets of which are slidably mounted upon said first guide rod, and the third and fourth plate support brackets of which are slidably mounted upon said second guide rod;

a support plate fixedly attached to said first, second, third, and fourth plate support brackets;

a first pneumatic actuator support bracket mounted upon said base plate at the center thereof;

a first pneumatic actuator affixed to said first pneumatic actuator support bracket, said first pneumatic actuator having a drive rod connected to said support plate, a first port connected to the second port of said three-way valve, and a second port connected to the third port of said three way valve;

four spiral springs, the first of which is positioned between said first guide rod support bracket and said first plate support bracket around said first guide rod, the second of which is positioned between said second guide rod support bracket and said second plate support bracket around said first guide rod, the third of which is positioned between said third guide rod support bracket and said third plate support bracket around said second guide rod, and the fourth of which is positioned between said fourth guide rod support bracket and said fourth plate support bracket around said second guide rod;

a pair of rectangular shaped support blocks mounted upon said support plate, each support block of which has located therein a channel with the channel of said first support block being in alignment with the channel of said second support block;

an adjustable height weapons support stand having a pair of legs, each leg of which has on the end thereof a tip, with the tip of the first of said pair of legs adapted to fit within the channel of the first of said pair of support blocks, and with the tip of the second of said pair of legs adapted to fit within the channel of the second of said pair of support blocks;

a weight loss simulator support bar fixedly attached to said adjustable height weapons support stand;

a weight support bar rotatably connected at one end thereof to the lower end of said weight loss simulator support bar;

a weight affixed to the opposite end of said weight support bar, said weight having an internally threaded aperture extending therethrough;

a second pneumatic actuator support bracket affixed to the upper end of said weight loss simulator support bar;

a second pneumatic actuator rotatably connected to said second pneumatic actuator support bracket, said second pneumatic actuator having a drive rod, and a port connected to the second port of said first orifice and the first port of said check valve;

a chain connected at one end thereof to the drive rod of said second pneumatic actuator, and at the opposite end thereof to said weight support bar adjacent said weight; and a weapons brace assembly rotatably mounted upon said adjustable height weapons support stand, said weapons brace assembly having a yoke affixed to the periphery of said imitation weapon.

9. The recoil force and weight loss simulation apparatus of claim 8 wherein said weapon is a Dragon missile launcher.

10. The recoil force and weight loss simulation apparatus of claim 8 further characterized by a discharge line connected at one end thereof to the fourth port of said four-way valve.

11. The recoil force and weight loss simulation apparatus of claim 8 further characterized by an adjustable weight support assembly having an externally threaded rod adapted to mate with the internally threaded aperture of said weight, an adjustment knob affixed to the upper end of said externally threaded rod, and a bumper affixed to the lower end of said externally threaded rod.

12. The recoil force and weight loss simulation apparatus of claim 8 further characterized by a support stand adapted to support said imitation weapon whenever said imitation weapon is not being utilized to train a marksman.

* * * * *